United States Patent [19]

Perfetti et al.

[11] Patent Number: 4,924,883

[45] Date of Patent: May 15, 1990

[54] SMOKING ARTICLE

[75] Inventors: Thomas A. Perfetti; Amos E. Westmoreland, both of Winston-Salem, N.C.

[73] Assignee: R. J. Reynolds Tobacco Company, Winston-Salem, N.C.

[21] Appl. No.: 23,051

[22] Filed: Mar. 6, 1987

[51] Int. Cl.[5] ..... A24D 3/00

[52] U.S. Cl. ..... 131/336; 131/335

[58] Field of Search ..... 131/335, 336, 360, 364

[56] References Cited

U.S. PATENT DOCUMENTS

| | | | |
|---|---|---|---|
| 235,885 | 12/1880 | Lindsley . | |
| 2,104,266 | 1/1938 | McCormick . | |
| 2,819,720 | 1/1958 | Burbig | 131/336 |
| 2,907,686 | 10/1959 | Siegel . | |
| 3,258,015 | 6/1966 | Ellis et al. . | |
| 3,280,823 | 10/1966 | Bauley et al. | 131/336 |
| 3,353,543 | 11/1967 | Sproull et al. . | |
| 3,356,094 | 12/1967 | Ellis et al. . | |
| 3,368,566 | 2/1968 | Avedikian . | |
| 3,397,700 | 8/1968 | Harlow et al. | 131/335 |
| 3,410,273 | 11/1968 | Bolles . | |
| 3,496,945 | 2/1970 | Tomkin | 131/336 |
| 3,515,146 | 6/1970 | Nealis | 131/335 |
| 3,516,417 | 6/1970 | Moses . | |
| 3,584,630 | 6/1971 | Innskeep . | |
| 3,664,350 | 5/1972 | Wall . | |
| 3,695,275 | 10/1972 | Hayward . | |
| 3,713,451 | 1/1973 | Bromberg . | |
| 3,744,496 | 7/1973 | McCarty et al. | 131/353 |
| 3,773,053 | 11/1973 | Stephens, Jr. . | |
| 3,774,622 | 11/1973 | Steigewald . | |
| 3,847,161 | 11/1974 | Morgenstern . | |
| 3,858,587 | 1/1975 | Carvelli et al. . | |
| 3,910,287 | 10/1975 | Walton . | |
| 3,913,590 | 10/1975 | Sway . | |
| 4,044,778 | 8/1977 | Cohn . | |
| 4,273,141 | 6/1981 | Van Tilburg . | |
| 4,291,711 | 9/1981 | Berger | 131/336 |
| 4,291,712 | 9/1981 | Koster et al. . | |
| 4,340,072 | 7/1982 | Bolt et al. . | |
| 4,357,950 | 11/1982 | Berger . | |
| 4,407,308 | 10/1983 | Baker et al. . | |
| 4,433,696 | 2/1984 | Adams . | |
| 4,474,191 | 10/1984 | Steiner . | |
| 4,637,410 | 1/1987 | Luke | 131/360 |
| 4,714,082 | 12/1987 | Banerjee et al. . | |

FOREIGN PATENT DOCUMENTS

| | | |
|---|---|---|
| 174645 | 9/1984 | European Pat. Off. . |
| 8602528 | 11/1984 | PCT Int'l Appl. . |
| 1185887 | 3/1970 | United Kingdom . |
| 2091078 | 7/1982 | United Kingdom . |

OTHER PUBLICATIONS

Guinnes Book of World Records, 1985 Edition, pp. 242–243.

Factors Influencing the Elution of High-Boiling Components of Cigarette Smoke from Filter from Beitrage zur Tabakforschung, Band 5, Heft 2, Aug. 1969.

A Method for Measuring the Elution of Nicotine and Total Particulate Matter from a Cigarette Filter from Beitrage zur Tabakforschung, Band 7, Heft 1, Jan. 1973.

*Primary Examiner*—V. Millin

*Assistant Examiner*—Jennifer L. Doyle

[57] ABSTRACT

A cigarette-type smoking article has a short tobacco-containing fuel element, a passageway for mainstream tobacco smoke flow, a flavor source which provides enhanced flavor to the tobacco smoke which passes therethrough, and a mouthend piece. The article is highly air diluted and the air dilution is provided through the periphery of the article as perforations in a region immediately behind the fuel element. Such an article delivers highly flavored mainstream tobacco smoke and relatively low levels of pyrolysis and/or combustion derived wet total particulate matter.

29 Claims, 1 Drawing Sheet

SMOKING ARTICLE

BACKGROUND OF THE INVENTION

This invention relates to a smoking article, and in particular to a smoking article capable of delivering a flavored aerosol.

Although smoking articles such as cigarettes have remained as popular consumer products, various new types of cigarette-type flavor delivery systems have been proposed. For example, as proposed in U.S. Pat. No. 4,079,742 to Rainer et al, tobacco substitutes can provided from a wide variety of treated and untreated plant materials. However, it is believed that various types of tobacco substitutes, such as are provided by the modification of cellulose materials, are not completely satisfactory as a tobacco substitute.

Numerous aerosol generating smoking articles based on heat generation have been proposed. For example, substitute cigarette filler materials such as carbon fibers treated with flavorant are proposed in U.S. Pat. Nos. 3,738,374 to Bennett; 3,943,941 to Boyd; 4,044,777 to Boyd; 4,286,604 to Ehretsmann et al; 4,326,544 to Hardwick et al and British Pat. No. 1,431,045.

Some proposed aerosol generating smoking articles are believed to have used a heat or fuel source in order to produce an aerosol. One of the earliest of these proposed articles is described by Siegel in U.S. Pat. No. 2,907,686. The Siegel reference proposes a cigarette substitute which includes an absorbent carbon fuel, preferably a 2.5 inch (63.5 mm) stick of charcoal, which is burnable to produce hot gases, and a flavoring agent carried by the fuel, which is adapted to be distilled off incident to the production of the hot gases. Siegel also proposes that a separate carrier, such as clay, may be used for the flavoring agent, and that a smoke-forming agent, such as glycerol, may be admixed with the flavoring agent. Siegel's proposed cigarette substitute may be coated with a concentrated sugar solution to provide an impervious coat and to force the hot gases and flavoring agents to flow toward the mouth of the user.

Another smoking article is described by Ellis et al in U.S. Pat. No. 3,258,015. Ellis et al proposes a smoking article which has an outer cylinder of fuel having good smoldering characteristics, preferably fine cut tobacco or reconstituted tobacco, surrounding a metal tube containing tobacco, reconstituted tobacco, or other source of nicotine and water vapor. It is believed that upon smoking, the burning fuel heats the nicotine source material to cause the release of nicotine vapor and potentially aerosol generating material, including water vapor. It is proposed that the vaporized materials are mixed with heated air which enters the open end of the tube. A substantial disadvantage of this article includes the ultimate protrusion of the metal tube as the tobacco fuel is consumed.

In U.S. Pat. No. 3,356,094, Ellis et al disclose a modification of their original design to eliminate the protruding metal tube upon use. The allegedly improved design employed a tube made out of a material, such as certain inorganic salts or an epoxy bonded ceramic, which is disclosed as becoming frangible tube is disclosed as being removable when the smoker eliminates ash from the end of the article. Even though the appearance of this article is very similar to a conventional cigarette, apparently no commercial product ever has been marketed.

Bolt et al, in U.S. Pat. No. 4,340,072, proposes a smoking article having a fuel rod with a central air passageway and a mouthend chamber containing an aerosol forming agent. The fuel rod preferably is a molding or extrusion of reconstituted tobacco and/or tobacco substitute, although the patent also proposes the use of tobacco, a mixture of tobacco substitute material and carbon, or a sodium carboxymethylcellulose (SCMC) and carbon mixture. The aerosol forming agent is proposed to be a nicotine source material, or granules or microcapsules of a flavorant in triacetin or benzyl benzoate. Upon burning during use of the article, air enters the air passage where it is mixed with combustion gases from the burning rod. The flow of these hot gases reportedly ruptures the granules or microcapsules to release the volatile material. This material reportedly forms an aerosol and/or is transferred into the mainstream aerosol. It is believed that the articles of Bolt et al, due in part to the long fuel rod, would produce insufficient aerosol from the aerosol former to be acceptable, especially in the early puffs. The use of microcapsules or granules further would appear to impair aerosol delivery because of the heat needed to rupture the wall material.

U.S. Pat. No. 3,516,417 to Moses proposes a smoking article, with a tobacco fuel, which is essentially identical to the article of Bolt et al, except that Moses proposes a double density plug of tobacco in lieu of the granular or microencapsulated flavorant of Bolt et al. (See FIG. 4, and col. 4 lines 17–35 of the Moses reference.) Similar tobacco-based fuel articles are described in U.S. Pat. No. 4,347,855 to Lanzilotti et al and in U.S. Pat. No. 4,391,285 to Burnett et al. European Patent Application No. 117,355, by Hearn et al, describes similar smoking articles having a pyrolyzed ligno-cellulosic heat source with an axial passageway therein. These articles would be expected to suffer many of the same problems as the articles proposed by Bolt et al.

Steiner, in U.S. Pat. No. 4,474,191, describes "smoking devices" containing an air-intake channel which, except during the lighting of the device, is completely isolated from the combustion chamber by a fire resistant wall. To assist in the lighting of the device, Steiner proposes providing a means for allowing the brief, temporary passage of air between the combustion chamber and the air-intake channel. Steiner's heat conductive wall also serves as a deposition area for nicotine and other volatile or sublimable tobacco simulating substances. In one embodiment (FIGS. 9 and 10), the Steiner device is provided with a hard, heat transmitting envelope. Materials reported to be useful for the envelope include ceramics, graphite, metals, etc. In another embodiment, Steiner envisions the replacement of the tobacco (or other combustible material) fuel source with some purified cellulose-based product in an open cell configuration, mixed with activated charcoal. This material, when impregnated with an aromatic substance, is stated to dispense a smoke-free, tobaccolike aroma.

None of the foregoing types of smoking articles have ever achieved any commercial success, and it is believed that none has ever been widely marketed. The absence of such smoking articles from the marketplace is believed to be due to a variety of reasons, including insufficient aerosol generation, both initially and over the life of the product, poor taste, off-taste due to the thermal degradation of the smoke former and/or flavor agents.

More recently, Sensabaugh et al, in European Patent Application No. 174,645, describe smoking articles having fuel elements, preferably carbonaceous fuel elements, normally in a heat exchange relationship with a substrate bearing an aerosol forming material. Generally, the aerosol forming material includes at least one polyhydric alcohol and volatile flavoring agents and air can be drawn into the article through the fuel element end of the article or through peripheral perforations along the length of the article. During use of the article, the burning fuel element generates heat used in volatilizing the physically separate aerosol forming materials. The aerosol so formed then is drawn into the mouth of the user.

It would seem desirable to provide a smoking article capable of delivering mainstream tobacco smoke having a high level of flavor while simultaneously delivering a low level of pyrolysis and/or combustion derived wet total particulate matter (WTPM).

SUMMARY OF THE INVENTION

The present invention relates to a smoking article capable of delivering a high level of flavor while delivering minimal amounts of pyrolysis and/or combustion derived wet total particulate matter (WTPM). The smoking article has a cigarette-type appearance, and provides an aerosol characteristic of burning tobacco material. Thus, the article of the present invention is able to provide the user with the many advantages and benefits of cigarette smoking while delivering relatively low levels of pyrolysis or combustion products. In particular, the article of this invention is capable of delivering good tobacco taste, pleasure and smoking satisfaction to the user thereof.

The present invention relates to a smoking article having a tobacco-containing fuel element which is capable of providing tobacco smoke upon combustion. The article also includes a flavor source, physically separate from the fuel element. The fuel element is in flow communication with the flavor source, and the flavor source is capable of having the mainstream tobacco smoke pass into contact therewith thereby providing tobacco smoke having an enhanced flavor. For example, at least one passageway is positioned between the fuel element and the flavor source for draw induced passage of tobacco smoke from the burning fuel element to the flavor source. Air dilution means provides for dilution of the tobacco smoke, before and/or during the time period that the tobacco smoke is passed through the flavor source. Preferably, the means for providing air dilution to the article is positioned in a region longitudinally spaced from the fuel element but as far from the extreme mouthend of the article as possible.

In one preferred aspect of the present invention, the smoking article has at one extreme end a relatively short charge of particulates of tobacco material which is densely or tightly packed to provide a combustible fuel element (eg., an aerosol formation source) normally having a low burn rate, both during draw and during smolder. Although the preferred particulates are densely packed, the void volume therebetween allows for draw induced airflow through the fuel element thus providing mainstream tobacco smoke flow. A flavor source, which includes a substrate and at least one flavorant, is positioned physically separate from and in a spaced apart relationship with the aerosol formation source. A passageway for mainstream tobacco smoke flow is positioned between the aerosol formation source and the flavor source. A mouthend piece is positioned at one extreme end of the smoking article in order that draw induced, flavor enhanced tobacco smoke is delivered to the mouth of the user. In addition, the article is highly air diluted (eg., with peripheral perforations or other types of air inlet vents) in order to provide for the mixing of appreciable amounts of environmental air with the mainstream tobacco smoke.

The pressure drop of the article of this invention generally is comparable to that of a conventional cigarette. By the term "pressure drop" is meant the difference between atmospheric pressure and that pressure experienced at the extreme mouthend point of the smoking article during draw as measured at a given flow rate through the article. Typical pressure drop values for smoking articles range from 70 mm to 170 mm, preferably from about 90 mm to about 130 mm of water pressure drop at 17.5 ml/sec. of air flow rate.

In operation, the user lights the fuel element which thereby burns to produce an aerosol characteristic of conventional cigarette mainstream tobacco smoke. The aerosol is drawn through the article and into contact with the flavor source. The contact of the aerosol with the flavor source yields an aerosol having an enhanced flavor which is drawn into the mouth of the user. For example, the tobacco smoke is drawn or swept through the flavor source thereby eluting the flavors therefrom. The factors and mechanisms affecting elution are discussed by Curran and Miller in *Beitrage zur Tabakforschung,* Band 5, Heft 2, p. 64 (August, 1969); and by Curran and Kiefer in *Beitrage zur Tabakforschung,* Band 7, Heft 1, p. 29 (January, 1973). The peripheral perforations provide high levels of air dilution to the aerosol thereby providing a delivery of relatively low amounts of wet total particulate matter (WTPM) derived from pyrolysis and/or combustion of the fuel element relative to the desired amount of flavor delivered. The flavored aerosol so provided exits the mouthend region of the article and into the mouth of the user.

As used herein, and only for purposes of describing this invention, "tobacco smoke" is meant to include the aerosol provided by the combustion and/or pyrolysis of tobacco material, and having the vapor and suspended phases uniquely derived from such combustion or pyrolysis. The term "tobacco smoke" is especially meant to refer to mainstream smoke which is drawn through the article to the mouth of the user.

As used herein, and only for purposes of describing this invention, "aerosol" is meant to include an aerocolloidal system including vapors, gases, particulates of solids and liquids, and the like. The aerocolloidal system may be visible or invisible.

As used herein, and only for purposes of describing this invention, "low burn rate" in referring to the fuel element is meant that upon being lit, and both during draw and during smolder, a relatively short length of the fuel element is consumed.

As used herein, and only for purposes of this invention, "elution" is meant the process whereby a volatile or semi-volatile material carried by a substrate is transferred to an aerosol passing the substrate. The transfer of the volatile or semi-volatile material thus provided is greater than would be expected by simple vaporization. In particular, elution relates to a mechanism whereby the volatile or semi-volatile materials both vaporized from the substrate and are adsorbed or absorbed by the particulate phase.

As used herein, the term "air dilution" is the ratio (generally expressed as a percentage) of the volume of air drawn through the air dilution vents, openings or perforations to the total volume of air, smoke and flavorant drawn through the smoking article and exiting the extreme mouthend portion of the smoking article.

By the term "volatile" in referring to a material is meant the characteristic of that material to undergo a phase change from liquid or solid phase to gas phase under ambient conditions of temperature and pressure.

By the term "semi-volatile" in referring to a material is meant the characteristic of that material to undergo volatilization under conditions different from ambient conditions of temperature and pressure.

The articles of this invention are capable of delivering at least 5 puffs, less than 5 mg of pyrolysis and/or combustion derived WTPM, and less than 4 mg CO, when smoked under FTC smoking conditions. Of particular interest are articles capable of delivering between about 6 and about 10 puffs (i.e., comparable to a conventional cigarette) when smoked under FTC smoking conditions. (FTC smoking conditions consist of two seconds of puffing (35 ml total volume) separated by 58 seconds of smolder.)

DETAILED DESCRIPTION OF THE PREFERRED EMBODIMENTS

Figure 1:
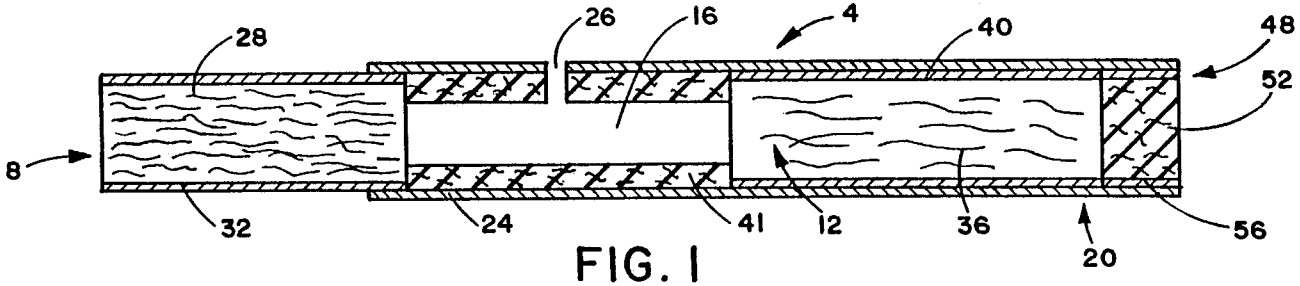
FIGS. 1, 2 and 3 are longitudinal sectional views of embodiments of the invention.
Figure 2:
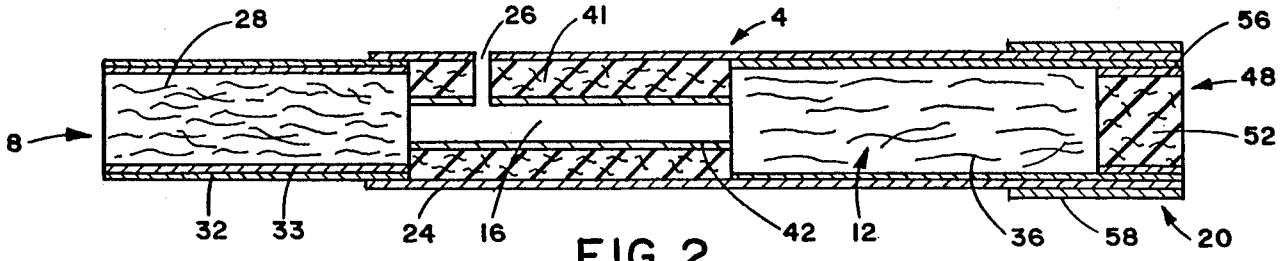
Figure 3:
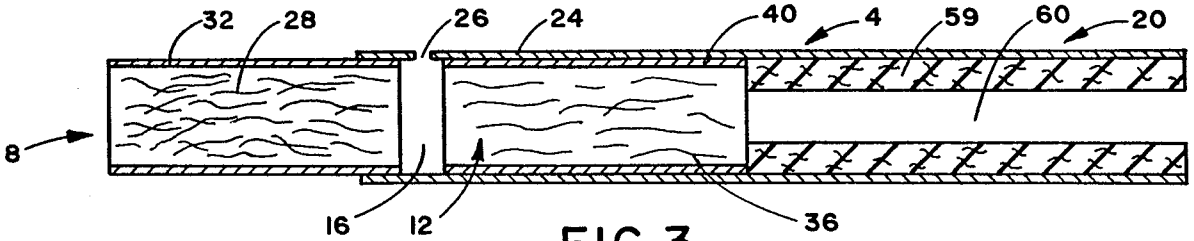

Referring to FIGS. 1 through 3, cigarette-type smoking article 4 includes a cylindrical fuel element 8, a cylindrical flavor source 12 positioned physically separate from and in a spaced apart relationship relative to the fuel element, a passageway 16 between the fuel element and the flavor source, a mouthend region 20, and a circumscribing outer wrapping material 24. Air dilution is provided by one or more perforations 26 positioned along the length of the article in the region between the fuel element 8 and the flavor source 12. Preferably, each of the articles has a rod-like, generally elongated shape comparable to a conventional cigarette in weight, size, shape, feel, and the like. The length of the article can vary, and generally ranges from about 55 mm to about 120 mm, preferably from about 80 mm to about 100 mm.

Fuel element 8 is positioned at one extreme end of the article and includes combustible material 28 capable of providing an aerosol in the form of tobacco smoke upon combustion contained in a circumscribing wrapping material 32. As shown in FIG. 2, the fuel element can include tobacco material 28 which is doubly wrapped in inner layer of wrapping material 33 and outer layer of wrapping material 32 in order to assist in reducing the burn rate characteristic of the fuel element. Preferably, the tobacco material is in the form of strands of processed and/or unprocessed tobacco. Such strands exhibit desirable burning characteristics, and the ability to provide an interspacial void volume upon packing which provides for airflow through the fuel element in order that the mainstream aerosol can be provided. The dimensions of the fuel element can vary, but generally the length thereof ranges from about 20 mm to about 55 mm, preferably from about 25 mm to about 40 mm; while the circumference thereof ranges from about 19 mm to about 28 mm.

Flavor source 12 includes a material 36 which carries, contains or provides at least one flavorant. For example, a suitable substrate can carry or contain the flavorant(s). The flavor source has a configuration and positioning such that the mainstream tobacco smoke can pass into contact therewith. For example, a flavor source having a fibrous substrate or a substrate provided from shredded tobacco material can have an interspacial void volume such that the mainstream smoke can pass therethrough and can contact the substrate over a relatively large surface area. As shown in FIGS. 1 and 3 the substrate can be contained in a circumscribing wrapping material 40. The wrapping material 40 assists in maintaining the substrate in the desired position within the article (eg., in a spaced apart relationship within the fuel element). As shown in FIG. 2, the substrate can be contained within the outer wrap 24 and held in place by friction fit, or other such manner. The dimensions of the flavor source can vary. For example, the length of the flavor source can vary, but generally ranges from about 10 mm to about 40 mm, preferably from about 20 mm to about 35 mm; while the diameter thereof approximates that of the fuel source 8.

The fuel element 8 and the flavor source 12 are positioned physically separate and in a spaced apart relationship relative to one another. The passageway 16 is a region along the length of the article which provides for flow communication between the fuel element and the flavor source. The length of the passageway is the distance between the rearmost end (i.e., mouthend) of the fuel element and the foremost end (i.e., the fuel element end) of the flavor source. Generally, the length of the passageway is about 4 mm or more, in order that flavorant of the flavor source is eluted therefrom by the action of "cool" aerosol (i.e., tobacco smoke having a temperature less than about 50°C). In addition, the air dilution provided by perforation(s) 26 can tend to cool the temperature of the aerosol provided from the burning fuel element. Elution of flavorant from the flavor source is preferred over vaporization of flavorant (eg., which is provided principally by the action of heat) in order that a relatively consistent delivery of flavorant can be delivered by the article during the useful lifetime of the article.

The passageway can be provided by the spaced apart nature of the fuel element and the flavor source. For example, as shown in FIG. 3, the outer boundaries of the passageway 16 can be provided by the outer wrap 24. Preferably, the outer boundaries of the passageway are provided by a material having a composition and form sufficient to provide some resilience to the article. In addition, it is desirable that the material forming the passageway not filter or interact with the mainstream aerosol to any appreciable degree. Furthermore, it is desirable that the configuration of the material forming the passageway be such so as to not affect the pressure drop or draw resistance of the article to any appreciable degree. For example, as shown in FIGS. 1 and 2, a tubular member 41 can be positioned between the fuel element and the flavor source.

Referring to FIGS. 1 and 2, tubular member 41 abuts the fuel element at the mouthend thereof and also abuts the foremost end (i.e., the fuel element end) of the flavor source. Typically, the outer diameter of the tubular member 41 approximates the diameter of the fuel source 8 and the diameter occupied by the flavor source 12. The inner circumference of the tubular member can vary and can approach the inner circumference provided by the outer wrap. The inner circumference of the tubular member generally ranges from about 8 mm to about 12 mm. The length of the tubular member can vary and generally ranges from about 10 mm to about 80 mm, preferably from about 15 mm to about 40 mm. The tubular member can be a cellulosic derivative such as cellulose acetate, paper or cardboard; foil-lined paper, a plastic such as polyethylene or polypropylene; a heat stable plastic such as a polyimide sold commercially as Kapton by E. I. DuPont de Nemours; or other such material. The hollow tubular member 41 provides a suitable passageway 16 for transfer of mainstream tobacco smoke from the burning fuel element to the flavor source. However, rather than a tubular member providing one passageway, a member providing several passageways can be employed.

As shown in FIG. 2, a second tubular member 42 manufactured from polyimide, foil, or the like, can be positioned within the annular section of tubular member 41 to form a passageway therethrough.

The mouthend region 20 is positioned adjacent one end of the flavor source 12. Optionally, the mouthend region includes filter element 48 which includes filter material 52, and can include circumscribing paper plug wrap 56. The length of the filter element can vary but generally ranges from about 10 mm to about 30 mm. Typically, the diameter of the filter element approximates that of the flavor source. The filter material can be cellulose acetate tow, polypropylene tow, paper, or other suitable material. The composition and design of the filter element can vary in order to exhibit the desired filtration and delivery characteristics; however, for certain applications a low efficiency filter is frequently desirable.

As shown in FIG. 3, the mouthend piece can be a tubular member 59 or other means for providing a resilient region as well as a passageway 60 or other means for providing a passage of flavor enhanced aerosol to the mouth of the user. The length of tubular member 59 can vary and can range from about 20 mm to about 30 mm.

Outer wrapping material 24 circumscribes and is adhesively secured to outer peripheral surfaces of the mouthend region, the wrapping material of the flavor source, the tubular member and the fuel element. The length which the outer wrapping material extends along the fuel element can vary. As the outer wrap often can be tipping paper which is treated with burn suppressants, the length which the outer wrap extends along the fuel element can be a distance which defines the length of the fuel element which is burned during use. Thus, the outer wrapping material can be one factor in determining the puff count of the smoking article, the delivery of WTPM, and other such characteristics of the article. The outer wrapping material 24 provides an aesthetically pleasing smoking article as well as a means for securing the various components in the desired configuration.

The outer wrapping material 24 generally is a conventional tipping paper, cigarette paper, or the like. The physical properties of the wrapping material (eg., basis weight, porosity, permeability, composition of filler material, composition of cellulosic fillers, and the like) can be selected as desired for the particular smoking article which is manufactured. As shown in FIG. 2, circumscribing wrap 58 can be applied to the article near the mouthend thereof in order to simulate tipping paper.

A series of perforations 26, vents, a region of porosity or other means for allowing environmental air to enter the article are provided to the article through the outer wrapping material 24 and the tubular member 41 thereby providing air dilution to the article. Most preferably, the perforations of the outer wrapper 24 are positioned in a region thereof which overlies a region physically separate from the fuel element. Additional means for providing air dilution can be positioned throughout the article. For example, perforations or vents can be provided such that environmental air enters the article peripherally through the flavor source or the filter element. The positioning of the air dilution means can optimize the desired delivery performance characteristics (eg., pressure drop, WTPM delivery, vapor phase delivery, flavor delivery, and the like) of the article. It is desirable for many applications to position the perforations immediately behind the fuel element. For example, the perforations can be positioned along the periphery of the article about 2 mm to about 10 mm behind the rearmost end of the fuel element. For a typical smoking article, the number of perforations range from about 3 to about 1000, and the size of each perforation ranges from 1 $mm^2$ to 0.0015 $mm^2$. For a typical article, the level of air dilution ranges from about 30 percent to about 90 percent, frequently from about 50 percent to about 85 percent, more frequently from about 60 percent to about 80 percent. The total surface area of the perforations and the positioning of the perforations along the periphery of the article can be varied in order to control the performance characteristics of the smoking article.

It is most preferred to position the air dilution means as far from the extreme mouthend of the article as possible but in a region physically separate from the fuel element. Such positioning of the air dilution means provides for aerosol which is air diluted (frequently to a relatively high degree) and then further flavored by passage into contact with the flavor source. In particular, it is preferable that at least a majority of the air dilution of the mainstream smoke be provided prior to the time that the smoke passes into contact with the flavor source. It is most desirable to air dilute the tobacco smoke from the burning fuel element and then enhance to a high degree the flavor of the aerosol having a relatively low level of WTPM from the pyrolysis and/or combustion of the fuel element, rather than to air dilute a flavored aerosol. For example, air diluting an aerosol having enhanced flavor lowers not only the level of WTPM from the burning fuel element but also the level of flavor within the aerosol.

The fuel element 8 is an aerosol formation source wherein tobacco material is ignited and upon combustion and/or pyrolysis yields tobacco smoke. Examples of tobacco materials include flue-cured, Maryland, Burley and Oriental tobaccos; reprocessed tobacco materials; volume expanded tobacco materials and other processed tobacco materials; processed tobacco stems; and other such materials as well as blends thereof. Carbonized or pyrolyzed materials as well as tobacco substitutes can be blended with the tobacco materials, if desired. Preferably, the tobacco materials are employed in particulate form, and most preferably in the form of strands such as cut filler. Typical strands have widths which range from about 1/20 inch to about 1/90 inch, preferably from about 1/25 inch to about 1/50 inch; and lengths which range from about 0.25 inch to about 3 inches.

Preferred fuel elements are provided from densely or firmly packed tobacco materials. That is, the particles or strands which make up the fuel element are packed so as to have a relatively low interspacial void volume therebetween. Most preferred fuel elements have a low to moderate weight, and a low burn rate. Volume expanded tobacco materials, when densely packed (i.e., so as to have a low interspacial void volume), can provide the desired low weight fuel elements as well the desired slow burn rate, both during draw and during smolder. Expanded tobacco materials are those tobacco materials (generally in particulate or strand form) which are impregnated with volatile materials (such as the commercially available freons, propane, carbon dioxide, and the like), and the impregnated materials are rapidly removed from the tobacco materials thus expanding the cellular structure of the tobacco materials.

Fuel elements having a slow burn rate also can be provided by employing relatively small sized particles of tobacco material or relatively thin strands of tobacco material, each of which can provide fuel elements of relatively low interspacial void volumes. In addition, denser or slower burning tobacco materials can provide fuel elements of low smolder burn rate, particularly when densely packed. Examples of relatively dense tobacco materials include reconstituted tobacco materials, dense leaf such as Oriental tobacco or the so called "Green River" tobaccos. Although fuel elements of this invention can have densities which can vary, generally densities of the fuel elements range from about 0.15 g/cc to about 0.35 g/cc, more frequently from about 0.20 g/cc to about 0.25 g/cc. Densely packed fuel elements having slow burn rates generally have pressure drop values between about 50 mm and about 900 mm, more generally about 100 mm to about 500 mm, of water pressure drop at 17.5 ml/sec of air flow rate per 100 mm length of fuel rod. Typical fuel elements have firmness values between about 2 units and about 14 units as determined for a 100 mm rod using the Firmness Tester Model No. CFTA supplied by Fairchild Industries, Winston-Salem, N.C.

The fuel element wrapping materials 32 and 33 can affect the burn properties (eg., burn rate characteristics) of the fuel element. For example, wrapping materials prepared from flax or wood pulp and incorporating burn rate suppressors (eg., sodium silicate) can provide a fuel element of a slow burn rate. In addition, fuel elements having wrapping materials of relatively low air permeabilities and/or having more than one layer of wrapping material (eg., a double wrapper configuration) can provide a fuel element having a relatively slow burn rate, both during draw and during smolder.

Preferred fuel elements have a low puffing burn rate. For example, for a typical cigarette type smoking article having a fuel element with a circumference ranging from about 19 mm to about 28 mm and which is smoked under FTC conditions, the puffing burn rate typically ranges from about 1 mm to about 3 mm along the length thereof during the 2 second puff interval of FTC conditions. Typically, the smolder burn rate of such a typical article, when smoked under FTC conditions, ranges from about 2 mm to about 5 mm during the 58 second smolder interval of FTC Preferred fuel elements are ignited using a cigarette lighter in much the same manner as are conventional cigarettes.

The flavor source includes a substrate which in turn carries or contains at least one flavorant or other agent which can modify the character of the tobacco smoke. The substrate preferably has a low to moderate affinity for (i.e., ability to hold, bind or contain) the flavorant(s) in order that the flavorant(s) can elute from the substrate by volatilization to some degree and transfer to the mainstream tobacco smoke. Thus, it is desirable that the flavorant(s) neither be irreversibly adsorbed on nor chemically reacted in an irreversible manner with the substrate. In addition, there is a balance between the affinity of the flavorant(s) for the substrate and the ability of the mainstream tobacco smoke to elute the flavorant(s) from the substrate.

Examples of suitable substrates include polymeric materials such as polypropylene tow; cellulosic materials such as cellulose acetate; carbonized materials such as charcoal; clays or alumina; graphite or carbon fibers; tobacco materials such as cut filler, cast sheet material, shredded reconstituted tobaccos or flavor engineered reconstituted tobacco sheets; and the like. The substrate has a shape, positioning or form (eg., a strands, fibers, particles, dust, or the like) to provide for the exposure of sufficiently great surface area to allow for substantial contact of the surface of the substrate with the mainstream tobacco smoke in flow communication therewith. Such contact of the mainstream tobacco smoke with the substrate allows for the transfer or elution of the flavorant from the substrate to the aerosol.

It is desirable to have a flavor source having a relatively great surface area in order that the aerosol can undergo a substantial amount of contact with the flavor source. Frequently, the flavor source extends a relatively great distance along the length of the article in order to allow for a high surface area as well as a suitable passageway for mainstream aerosol.

If desired, the optional filter element can carry or contain flavorant(s) for delivery with the mainstream tobacco smoke.

A variety of flavorants or combination of flavorants can be employed in the article of this invention. Typical flavorants are those volatile or semi-volatile flavorants which impart the desired flavor characteristic or component to the mainstream tobacco smoke. Example include organic or inorganic flavorants, flavor complexes, compounded flavorants, and the like. Examples of particular flavorants include medium to high molecular weight oils, nicotine, nicotine salts, menthol, anethole, vanillin, cocoa butters, terpenes, pyrazines, and the like. Additionally, desirable compounds include those which interact with tobacco smoke to transfer flavorant to the mainstream smoke. For example, beta-cyclodextrin having entrapped flavorant(s) can reversibly interact with tobacco smoke to liberate and transfer the flavorant to the mainstream. The flavorant or combination of flavorants which are employed depend upon factors such as the ability of the flavorant to be eluted by the mainstream tobacco smoke, the flavor characteristics and the flavor threshold of the flavorant. See *Tobacco Flavoring For Smoking Products* by Leffingwell et al, (1972).

The articles of this invention can be manufactured in a relatively simple fashion using known cigarette making materials, equipment and techniques which are modified as required. For example, tobacco rods can be made using conventional cigarette rod making techniques and divided into cylindrical shaped segments in order to be employed as fuel elements and flavor sources. Passageways can be provided using cellulose acetate tubular members common in smoking article manufacture. Mouthend pieces can be manufactured using known filter making techniques. The various components can be combined using modified plug combination techniques and conventional cigarette paper or tipping paper circumscribing wrap. The air dilution means can be provided using suitable perforating techniques.

The following example is provided in order to further illustrate the invention but should not be construed as limiting the scope thereof. Unless otherwise noted, all parts and percentages are by weight.

EXAMPLE 1

A smoking article substantially as illustrated in FIG. 1 and having a length of 84 mm is manufactured according to the following procedure. The article is designated Sample No. 1.

A mixture of volume expanded flue-cured tobacco and Burley tobacco is provided. Each of the tobaccos are provided in the form of strands obtained from tobacco leaf lamina cut at about 32 cuts per inch. The lengths of the strands which predominantly range from about 0.25 inch to about 3 inches. The strands are subjected to volume expansion using a batch expansion process and a fluorocarbon expansion agent generally as described in U.S. Pat. No. 3,524,451 to Fredrickson. The flue-cured tobacco is subjected to 110 percent volume expansion; and the Burley tobacco is subjected to 80 percent volume expansion. The resulting mixture is 35 percent flue-cured tobacco and 65, percent Burley tobacco.

The flue-cured tobacco and Burley tobacco mixture is formed into a continuous rod using a Molins 686 Cigarette Making Machine. The rod has a circumference of 24.8 mm and the circumscribing wrap is a flax cigarette paper having a CORESTA porosity of about 30 cm/sec and a base weight of about 25 g/m$^2$ from Kimberly-Clark Corp., Roswell, Ga. A cylindrical segment of the rod having a length of 27 mm is provided as the fuel element. The tobaccos are densely packed within the rod such that the fuel element so provided weighs 0.2930 g. In particular, the strands of volume expanded tobaccos are tightly packed in order to have a relatively small void volume.

The smoking article is assembled by axially aligning the fuel element, a cellulose acetate tube, the flavor source and a filter element. The article is held together by a 61 mm length of circumscribing outer wrap adhesively secured to the outer peripheral surfaces of the filter element, cellulose acetate tube and the fuel element. The outer wrap extends over the length of the filter element, the flavor source, the cellulose acetate tube, and 4 mm along the end of the fuel element in the region thereof adjacent the cellulose acetate tube. The outer wrap is commercially available as a nonporous wood pulp tipping paper available from Kimberly-Clark Corp.

The cylindrical filter element has a length of 10 mm and a circumference of 24.53 mm. The filter element includes generally longitudinally extending cellulose acetate tow. The tow is 8 denier per filament with 40,000 total denier, and has a "Y" cross section. The tow is circumscribed by a nonporous wood pulp plug wrap available from Kimberly-Clark Corp. Such a filter element is manufactured using conventional cigarette filter making technology.

The cellulose acetate tube has a length of 20 mm, an outer diameter of about 8 mm, and an inner diameter of about 4.5 mm. The tube is plasticized and is resilient. The tube is sold commercially as SCS-1 by American Filtrona Corp.

The flavor source is 27 mm long and is provided from strands of reconstituted tobacco material treated with nicotine. The reconstituted tobacco material is manufactured using a conventional paper making procedure from a mixture of disc refined tobacco stems, tobacco scrap and tobacco dust by forming a base tobacco web of paper and applying a tobacco extract thereto. The sheet is dried, diced and cut into strands at 32 cuts per inch. The reconstituted sheet is provided from tobacco materials and contains the organic and inorganic materials found in the starting tobacco materials. The reconstituted tobacco material has a nicotine content of about 1 percent. A sample of the reconstituted tobacco material weighing about 0.3014 g is treated with 24.03 mg of 1-nicotine using a syringe to provide a substrate weighing 0.3254 g and having a total nicotine content of about 7.4 percent.

Air dilution is provided to the article by forming 4 perforations through the outer wrap and the cellulose acetate tube. The perforations are equally spaced about the periphery of the article at a distance of 47 mm from the extreme mouthend of the article. Each perforation is generally circular and is approximately 0.5 mm in diameter. The perforations provide an air diluted smoking article having an air dilution of about 85 percent.

The puff-by-puff profiles of "tar" and nicotine for the smoking article is provided using a smoking machine and modules. The smoking machine and modules required for this puff-by-puff analyses are similar to an apparatus commercially available from Heinr. Borgwaldt GmbH, Hamburg, West Germany. In this manner, a smoke delivery profile is provided. As used herein, the term "smoke delivery profile" in referring to a cigarette means the profile of provided, collected and analyzed smoke components, on a puff-by-puff basis when the cigarette is smoked under standard FTC conditions.

Data are presented in Table I.

TABLE I

| Puff No. | WTPM (mg) | TPM $H_2O$ (mg) | "Tar" (mg) | Nicotine (mg) |
|---|---|---|---|---|
| 1* | 0.175 | 0.175 | 0 | 0 |
| 2 | 0.2 | 0.515 | 0 | 0 |
| 3 | 0.2 | 0.08 | 0.11 | 0.01 |
| 4 | 0.3 | 0.075 | 0.191 | 0.034 |
| 5 | 0.4 | 0.32 | 0.0285 | 0.0515 |
| 6 | 0.7 | 0.47 | 0.134 | 0.096 |
| 7 | 1.3 | 0.62 | 0.496 | 0.184 |
| 8** | 0.2 | 0.065 | 0.135 | 0 |
| 9** | 0.14 | 0.14 | 0 | 0 |

*Data for Puff No. 1 are those amounts delivered for an unlit article.
**Data for Puff Nos. 8 and 9 are those amounts delivered after the article is extinguished.

The data in Table I indicate that no "tar" or nicotine is delivered before the smoking article is lit. In particular, without tobacco smoke, no flavorant in the form of "tar" or nicotine is transferred during draw. Upon lighting, the article delivers Puffs 2–7. The data show a delivery profile characteristic of "tar" and nicotine very similar to that of a conventional cigarette of comparable FTC "tar" delivery. Upon extinguishing the article by removing the ash and coal after Puff 7 and before Puff 8, the data show that the article delivers a low amount of "tar" and no nicotine. Such data indicate that the presence of mainstream tobacco smoke is required for delivery of eluted flavorant (eg., in this case, nicotine).

EXAMPLE 2

A smoking article substantially as illustrated in FIG. 1, and having a length of 84 mm is manufactured according to the following procedure.

An article having a 27 mm fuel element, plasticized cellulose acetate tube passageway, flavor source, filter element, outer wrap and air dilution perforations is manufactured, as described in Example 1. However, rather than using a nicotine treated reconstituted tobacco strands as a flavor source, the following flavor source is employed. The flavor source is strands of a blend of cased and flavored tobacco. The blend is 22 Burley tobacco, 3 percent flue-cured tobacco, 7 percent Oriental tobacco, 19 percent volume expanded Burley tobacco and 34 percent volume expanded flue-cured tobacco. The flavor source weighs 0.2376 g, and contains 3.59 mg of menthol.

The article is designated Sample No. 2.

EXAMPLE 3

A smoking article substantially as illustrated in FIGS. 1 and 2, and having a length of 84 mm is manufactured according to the following procedure.

An article having a 27 mm fuel element, plasticized cellulose acetate tube passageway, flavor source, filter element, outer wrap and air dilution perforations is manufactured, as described in Example 1. In addition, the amount of nicotine added to the flavor source is 35.91 mg. However, into the passageway of the cellulose acetate tube is inserted a polyimide tube having a length of 20 mm, an outer diameter of 4.5 mm and an inner diameter of 4.4 mm. The polyimide tube is sold commercially as Kapton by E. I. DuPont de Nemours.

The article is designated Sample No. 3.

EXAMPLE 4

A smoking article substantially as illustrated in FIG. 1, and having a length of 84 mm is manufactured according to the following procedure.

An article having a 27 mm fuel element, plasticized cellulose acetate tube passageway, flavor source, filter element, outer wrap and air dilution perforations is manufactured, as described in Example 1. In addition, the amount of nicotine added to the flavor source is 24.03 mg. However, the fuel element is doubly wrapped in paper wrap, rather than wrapped with one layer of circumscribing wrap. The inner wrap of the fuel element is a flax cigarette paper having a CORESTA porosity of about 20 cm/sec and a base weight of about 25 g/m$^2$. The outer wrap of the fuel element is a flax paper having a CORESTA porosity of about 5 cm/sec and a base weight of about 45 g/m$^2$ The article is designated as Sample No. 4.

EXAMPLE 5

A smoking article substantially as illustrated in FIG. 1, and having a length of 84 mm is manufactured according to the following procedure. The article is designated as Sample No. 5.

An article having a 27 mm fuel element, plasticized cellulose acetate tube passageway, flavor source, filter element, outer wrap and air dilution perforations is manufactured, as described in Example 1. However, rather than using nicotine treated reconstituted strands as a flavor source, the following flavor source is employed. The source is strands of the previously described reprocessed tobacco material which is not treated with nicotine and thereby has a nicotine content of about 1 percent.

COMPARATIVE EXAMPLE 6

A smoking article substantially as illustrated in FIG. 1, and having a length of 84 mm is manufactured according to the following procedure. The smoking article so manufatured for comparison purposes is designated as Sample No. C-1.

An article having a 27 mm fuel element, weighing 0.3223 g, plasticized cellulose acetate tube passageway, flavor source, filter element outer wrap and air dilution perforations is manufactured, as described in Example 1. The flavor source is reconstituted tobacco material and includes 24.03 mg of added nicotine as described in Example 1. However, the air dilution perforations provide 70 percent air dilution; and the fuel element is a 27 mm cylindrical segment of a non-tobacco cigarette rod (i.e., a segment of the burnable portion of the smoking article). The segment is obtained from a commercially available product sold under the tradename "Jazz" which is manufactured in Argentina, imported by Benson International, San Francisco, Calif. and advertised as a non-tobacco, non-nicotine cigarette. The filler material which is employed in the "Jazz" product is believed to be shredded dried lettuce.

COMPARISON OF SAMPLES

The various smoking articles are smoked under FTC conditions. Data concerning (i) the puff count, (ii) wet total particulate matter, (iii) water content of the total particulate matter, (iv) FTC nicotine, and (v) FTC "tar" are presented in Table II.

TABLE II

| Sample No. | Puff Count | WTPM (mg) | TPM $H_2O$ | FTC Nicotine (mg) | FTC "Tar" (mg) |
|---|---|---|---|---|---|
| 1 | 6 | 3.1 | 2.08 | 0.38 | 0.64 |
| 2 | 5.6 | 2.3 | 0.09 | 0.18 | 2.03 |
| 3 | 5.0 | 2.1 | 0.43 | 0.42 | 1.25 |
| 4 | 9.1 | 2.6 | 0.09 | 0.35 | 2.16 |
| 5 | 5.1 | 1.7 | 0.38 | 0.11 | 1.21 |
| C-1* | 4.2 | 1.1 | 0.56 | 0 | 0.54 |

*not an example of the invention.

The data in Table II indicate that mainstream tobacco smoke provides delivery of flavorants such as nicotine from the flavor source. In particular, Sample No. C-1, which does not have a tobacco containing fuel element, does not deliver nicotine during draw. In addition, the greater the amount of flavorant in the flavor source, the greater the level of elution of the flavorant from the article during use.

Sample No. 2 also delivers a substantial amount of menthol flavor in the mainstream aerosol. The delivery of menthol for the sample is similar to that of a conventional cigarette of comparable FTC "tar" delivery having a comparable menthol load.

The taste characteristics of Sample Nos. 1–5 are good. The samples deliver good satisfaction, good strength and good tobacco taste. Correspondingly, Sample No. C-1 has a poor taste, and delivers little flavor with very little strength.

What is claimed is:

1. A cigarette-type smoking article comprising:
(a) tobacco-containing fuel element having a length of less than about 50 mm and capable of providing tobacco smoke upon combustion,
(b) flavor source, physically separate from and in a spaced apart relationship with the fuel element, the flavor source capable of having mainstream tobacco smoke pass into contact therewith and thereby providing tobacco smoke with enhanced flavor,
(c) at least one passageway positioned between the fuel element and the flavor source for draw induced passage of tobacco smoke from the fuel element to the flavor source, the mainstream tobacco smoke undergoing essentially no filtration during passage along the length of the article from the fuel element to the flavor source,
(d) air dilution means for providing environment air through the periphery of the article thus providing air dilution of the tobacco smoke, the air dilution means positioned between the fuel element and the flavor source, and
(e) mouthend piece for delivery of the draw induced flavored tobacco smoke to the user of the article.

2. A cigarette-type smoking article comprising:
(a) tobacco-containing fuel element positioned at one extreme end of the article and being capable of providing tobacco smoke upon combustion, the fuel element having a length of about 25 mm to about 40 mm;
(b) flavor source, physically separate from and in a spaced apart relationship with the fuel element, the flavor source capable of having mainstream tobacco smoke from the fuel element pass into contact therewith and thereby providing tobacco smoke with enhanced flavor, the flavor source having a length from about 15 mm to about 40 mm;
(c) at least one passageway positioned between the fuel element and the flavor source for providing a draw induced passage of tobacco smoke from the fuel element to the flavor source, the mainstream tobacco smoke undergoing essentially no filtration during passage along the length of the article from the fuel element to the flavor source, the passageway having a length from about 4 mm to about 40 mm;
(d) air dilution means for providing environmental air through the periphery of the article between the fuel element and the flavor source; and
(e) mouthend piece.

3. The article of claim 2 wherein he mouthend piece is a filter element having length from about 10 mm to about 30 mm.

4. The article of claim 1 or 2 wherein the tobacco-containing fuel element includes particulates of volume expanded tobacco.

5. The article of claim 1 or 2 wherein the flavor source includes particulates of reconstituted tobacco material.

6. The article of claim 1 or 2 wherein the flavor source includes nicotine.

7. The article of claim 1 or 2 wherein the level of air dilution provided by the air dilution means ranges from about 50 percent to about 85 percent.

8. The article of claim 1 or 2 wherein the level of air dilution provided by the air dilution means ranges from about 60 percent to about 80 percent.

9. The article of claim 1 or 2 wherein the fuel element includes particulates of tobacco material having two or more layers of circumscribing wrap therearound.

10. The article of claim 1 wherein the fuel has a circumference which is between about 19 mm to about 28 mm.

11. The article of claim 2 wherein the fuel element has a circumference which is between about 19 mm to about 28 mm.

12. The article of claim 10 wherein the fuel element exhibits a puffing linear burn rate of about 1 mm to about 3 mm per puff interval and a smolder burn rate of about 2 mm to about 5 mm per smolder interval when the article is smoked under FTC conditions.

13. The article of claim 11 wherein the fuel element exhibits a puffing linear burn rate of about 1 mm to about 3 mm per puff interval and a smolder linear burn rate of about 2 mm to about 5 mm per puff interval when the article is smoked under FTC conditions.

14. The article of claim 1, 2, 12 or 13 which can deliver between about 6 and about 10 puffs when smoked under FTC conditions.

15. The article of claim 1, 2, 12 or 13 which can deliver at least 5 puffs when smoked under FTC conditions.

16. The article of claim 1, 10 or 12 wherein the length of the fuel element is less than 40 mm.

17. The article of claim 1 wherein the flavor source includes particulates of reconstituted tobacco material, and the level of air dilution provided by the air dilution means ranges from about 50 percent to about 85 percent.

18. The article of claim 1 wherein the flavor source includes particulates of reconstituted tobacco material, the level of air dilution provided by the air dilution means ranges from about 50 percent to about 85 percent, and the length of the fuel element is less than 40 mm.

19. The article of claim 1, 2 or 3 wherein the flavor source includes particulates of reconstituted tobacco material, and the level of air dilution provided by the air dilution means ranges from about 50 percent to about 85 percent.

20. The article of claim 3 wherein the mouthend piece is a filter element positioned adjacent the flavor source.

21. The article of claim 3 wherein the filter element is positioned adjacent the flavor source.

22. The article of claim 1, 17 or 18 wherein the air dilution means has the form of perforations through the periphery of the article and positioned from about 2 mm to about 10 mm behind the rearmost end of the fuel element.

23. The article of claim 2 wherein the air dilution means has the form of perforations through the periphery of the article and positioned from about 2 mm to abut 10 mm behind the rearmost end of the fuel element.

24. The article of claim 20 or 21 wherein the filter element contains flavorant for delivery with the flavor enhanced mainstream tobacco smoke.

25. The article of claim 1, 2, 17, 18 or 20 wherein in the fuel element has a density between about 0.15 g/cc and about 0.35 g/cc.

26. The article of claim 1, 2, 17, 18 or 20 wherein the fuel element has a density between about 0.20 g/cc and about 0.25 g/cc. the 27. The article of claim 1, 2, 17, 18 or 20 wherein the tobacco-containing fuel element includes particulates of tobacco.

28. The article of claim 1, 2, 17, 18 or 20 wherein the tobacco-containing fuel element consists essentially of particulates of tobacco circumscribed by an outer paper wrapping material.

29. The article of claim 1 or 2 wherein the passageway between the fuel element and the flavor source has a length of about 15 mm to about 40 mm.

* * * * *